US012678852B2

(12) United States Patent
Lemiale

(10) Patent No.: US 12,678,852 B2
(45) Date of Patent: Jul. 14, 2026

(54) METHOD FOR MANUFACTURING A METAL PACKAGING IN THE FORM OF A BOTTLE

(71) Applicant: TRIVIUM PACKAGING GROUP NETHERLANDS B.V., Deventer (NL)

(72) Inventor: Marc Lemiale, Bazouges-Cré sur Loir (FR)

(73) Assignee: TRIVIUM PACKAGING GROUP NETHERLANDS B.V., Deventer (NL)

( * ) Notice: Subject to any disclaimer, the term of this patent is extended or adjusted under 35 U.S.C. 154(b) by 360 days.

(21) Appl. No.: 18/254,796

(22) PCT Filed: Nov. 29, 2021

(86) PCT No.: PCT/EP2021/083395
§ 371 (c)(1),
(2) Date: May 26, 2023

(87) PCT Pub. No.: WO2022/112564
PCT Pub. Date: Jun. 2, 2022

(65) Prior Publication Data

US 2024/0001427 A1 Jan. 4, 2024

(30) Foreign Application Priority Data

Nov. 30, 2020 (FR) ..... 2012389

(51) Int. Cl.
*B21D 51/24* (2006.01)
*B21D 51/26* (2006.01)

(52) U.S. Cl.
CPC ..... *B21D 51/24* (2013.01); *B21D 51/2638* (2013.01)

(58) Field of Classification Search
CPC ..... B21D 51/24; B21D 51/2615; B21D 51/2623; B21D 51/38; B21D 51/2638
See application file for complete search history.

(56) References Cited

U.S. PATENT DOCUMENTS

| | | | | |
|---|---|---|---|---|
| 4,220,106 | A | 9/1980 | Supik | |
| 6,349,586 | B1 * | 2/2002 | Johnson | B21D 51/2615 413/69 |
| 9,943,899 | B2 * | 4/2018 | Pilon | H05B 6/101 |
| 10,906,081 | B2 * | 2/2021 | Niec | B21D 51/2646 |

(Continued)

FOREIGN PATENT DOCUMENTS

WO 2015054284 A2 4/2015

OTHER PUBLICATIONS

WO 2020/217629A1, Sasaki et al. Oct. 2020.*

(Continued)

*Primary Examiner* — Edward T Tolan
(74) *Attorney, Agent, or Firm* — NIXON & VANDERHYE

(57) ABSTRACT

Disclosed is a method for manufacturing a metal packaging in the form of a bottle. The method includes a step of forming a tubular part, in order to form a threaded neck. This manufacturing method includes, prior to at least one operation for forming a roll, preferably prior to the step of forming the tubular part, a step of localised annealing which is carried out in order to confer an annealed state on the tubular part, at least over the height of a downstream strip of the tubular part intended to be formed into a roll.

15 Claims, 9 Drawing Sheets

(56) References Cited

U.S. PATENT DOCUMENTS

| | | | | |
|---|---|---|---|---|
| 2010/0326164 | A1* | 12/2010 | Hanafusa | B67B 3/18 72/379.4 |
| 2011/0113732 | A1* | 5/2011 | Adams | B21D 51/26 53/452 |
| 2012/0024813 | A1* | 2/2012 | Nakagawa | B65D 1/0207 215/40 |
| 2015/0027974 | A1* | 1/2015 | Niec | B65D 1/0207 215/44 |
| 2016/0256910 | A1* | 9/2016 | Niec | B21D 51/2646 |
| 2017/0008656 | A1 | 1/2017 | Go et al. | |
| 2019/0001390 | A1* | 1/2019 | Dick | B21C 51/005 |

OTHER PUBLICATIONS

International Search Report for PCT/EP2021/083395 mailed Mar. 23, 2022, 7 pages.
Written Opinion of the ISA for PCT/EP2021/083395 mailed Mar. 23, 2022, 12 pages.

* cited by examiner

METHOD FOR MANUFACTURING A METAL PACKAGING IN THE FORM OF A BOTTLE

This application is the U.S. national phase of International Application No. PCT/EP2021/083395 filed Nov. 29, 2021, which designated the U.S. and claims priority to FR 2012389 filed Nov. 30, 2020, the entire contents of each of which are hereby incorporated by reference.

TECHNICAL FIELD OF THE INVENTION

The present invention relates to the technical field of bottle-shaped metal packagings.

In particular, it relates to the methods for manufacturing such bottle-shaped metal packagings, the neck of which comprises at least a roll, a thread and a transport ring.

STATE OF THE ART

Some bottle-shaped packagings include a threaded neck that is hermetically sealed, after filling, by means of a capsule.

The design of such a packaging has to take into account the constraints linked to its manufacturing, but also to its numerous handling operations at the filler's, from its receipt to the final packaging operations.

Moreover, according to their constitutive material, the packagings are obtained by manufacturing techniques that generate structural constraints leading to the implementation of conveyor systems that are dedicated thereto.

In this respect, the tubular part forming the mouth of the packagings made of plastic material (such as bottles or vials) generally includes an annular flange, projecting around the circumference and called "transport ring", useful for their individual handling.

These plastic-material packagings can be held, handled and/or transferred thanks to the positioning a generally fork-shaped handling device, resting below this transport ring.

In practice, for such plastic packagings, the mouth and transport ring thereof are formed simultaneously, for example on a preform (semi-finished part obtained by injection) before in injection-blowing or extrusion-blowing finishing.

Packagings made of metal material, for example steel or aluminium, are often devoid of such a transport ring due to the technical constraints linked to metal forming.

The manufacturing, handling and filling of such metal packagings thus lead to implementation of dedicated handling means.

Therefore, for the filler, shifting from plastic packagings to metal packagings requires significant investments in particular for transforming the handling means.

To remedy this problem, metal packaging developments exist, whose threaded neck, including in particular a terminal roll and a transport ring, would be adapted for being handled within installations usually dedicated to plastic packagings.

But, in practice, the technical constraints linked to metal forming generate brittleness during the forming of this threaded neck. The threaded neck of the metal bottle has also to be able to withstand the capsuling forces, while allowing a reduction of the metal thickness.

In view of the above, there exists a need for a technical solution for manufacturing metal bottles that would be provided with a threaded neck adapted to receive a capsule and that would be compatible with the plastic bottle filling lines, while allowing a thickness reduction of the metal wall thereof.

DISCLOSURE OF THE INVENTION

In order to remedy the above-mentioned drawback of the prior art, the present invention proposes a method for manufacturing such bottle-shaped metal packagings, the neck of which comprises at least a roll, a thread and a transport ring.

More particularly, it is proposed according to the invention a method for manufacturing a bottle-shaped metal packaging, said metal packaging having a body connected to a threaded neck through a shoulder.

The method according to the invention comprises:

- a step of manufacturing a preform including a tubular part, defining a longitudinal axis and a free, downstream edge, wherein said tubular part is connected to a body through a shoulder, and
- a step of forming said tubular part, to form said threaded neck.

The forming step comprises forming operations suitable to form one-piece structures on said tubular part:

- an operation of forming a roll within a downstream strip of said tubular part, ended by said downstream edge, to form a roll at the downstream edge of the threaded neck,
- an operation of forming a thread within an intermediate strip of said tubular part, and
- an operation of forming a transport ring within an upstream strip of said tubular part, on the shoulder side, intended to cooperate with a handling device (said transport ring advantageously comprising at least one moulding that is arranged on a plane extending perpendicularly to said longitudinal axis and along the tubular part circumference, said at least one moulding having a lower and/or upper surface against which a handling device is intended to rest).

And according to the invention, the manufacturing method comprises, prior to at least said roll forming operation, preferably prior to said tubular part forming step, a localised annealing step that is carried out in order to provide annealed state to the tubular part, at least over the height of the downstream strip of said tubular part.

The present invention thus offers a technical solution for manufacturing metal bottles that would be provided with a threaded neck adapted to receive a capsule and that would be compatible with the plastic bottle filling lines, while allowing a thickness reduction of the metal wall thereof.

Indeed, the roll is formed, above the thread, at the end of the preform tubular part. Often, the metal is wall ironed to form the preform then necked to form the threaded neck; however, the applicant has noticed that the metal might tear during the roll forming. This results in a significant proportion of the production being scrapped.

The applicant has noticed that annealing this area, by improving the formability thereof, allows for a reduction in the rate of cut necks.

Other non-limiting and advantageous features of the method according to the invention, taken individually or according to all the technically possible combinations, are the following:

- the localised annealing step is carried out to provide annealed state over a height of at least 3 to 7 mm of the downstream strip of said tubular part;

the localised annealing step is carried out to provide annealed state only at said downstream strip, only at the downstream strip and the upstream strip, in such a way as to keep at least part of the height of the intermediate strip in a non-annealed state, or at the downstream strip, the intermediate strip and the upstream strip;

the localised annealing step is carried out to provide annealed state over the height of the upstream strip of said tubular part, advantageously over a height of 5 to 15 mm;

the preform manufacturing step comprises a phase of deforming a metal part to obtain a primary preform having a bottom extended by a tubular wall, selected for example from drawing and/or wall ironing and/or inverted extrusion, for example drawing et/or wall ironing a metal blank, having for example a thickness of 0.2 mm to 0.7 mm, advantageously a technique selected from drawing and wall ironing (DWI) or drawing and re-drawing (DRD), or inverted extrusion from a slug of 2 to 15 mm, an edge trimming phase, to form a downstream edge of said primary preform, and a necking step, to form said tubular part of a secondary preform; and said step of localised annealing step is applied to the tubular wall of the primary preform, before said necking step;

the localised annealing step is carried out by an induction technique, advantageously within a tunnel inductor, advantageously with rotation of the preform;

the method comprises a step of necking the downstream strip of the tubular part prior to the roll forming operation; said roll forming operation being adjusted to form said roll towards the outside and in such a way that the outer diameter of said roll is lower than or equal to the thread bottom diameter;

the transport ring forming operation is implemented before the roll forming operation;

the transport ring is advantageously used for holding the tubular part during said roll forming operation;

the thread forming operation is applied to an intermediate strip that has a height of 10 to 25 mm;

the tubular part forming step also comprises an operation of forming a pilfer-proof counter-ring within an additional strip of the tubular part, located between the intermediate strip and the upstream strip, forming a pilfer-proof counter-ring groove between said pilfer-proof counter-ring and said transport ring;

the method also comprises a varnishing phase, preferably an external varnishing phase and an internal varnishing phase implemented after the localised annealing step;

the metal packaging is made in a 3000 or 5000 series aluminium alloy, for example 3104 aluminium alloy;

the transport ring forming operation is selected among a moulding technique, using for example an internal pressure exerted by a pressurized fluid or an elastomer compression, which causes the wall to conform to the shape of a mould, or a direct mechanical action using a movable tool, for example by spinning the metal by rotation of a wheel on the inner side of the tubular part while an outer wheel, facing the first one, holds the metal, or a technique of overlying and underlying necking;

the transport ring forming operation comprises a calibration phase to give a definitive shape to said transport ring; in this case, preferably, the calibration phase advantageously consists in bringing the upper connection radius and the lower connection radius of the transport ring in contact with each other, or in obtaining an upper connection radius and a lower connection radius of the transport ring that are radially offset with respect to each other, with said lower connection radius advantageously in abutment against the upper surface of the transport ring, in particular to ensure the transfer of the axial force towards the transport ring during a capsuling operation, and/or in bringing the external radius of the transport ring to a minimum radius acceptable to the constituent material; the calibration phase is advantageously carried out by clamping the annular deformation between two calibration rings that are coaxial to the longitudinal axis of the tubular part, or by two wheels in rotation about the tubular part, with advantageously the introduction into the tubular part of a centring mandrel during calibration to ensure concentricity of the overlying and underlying parts of the tubular parts;

during the transport ring forming operation, an axial load is exerted on the metal packaging to accompany the metal in its deformation and avoid thinning and breakage;

the method also comprises a step of putting a metal capsule on the threaded neck.

The present invention also relates to the bottle-shaped metal packaging resulting from a method according to the invention.

Obviously, the different features, alternatives and embodiments of the invention can be associated with each other according to various combinations, insofar as they are not incompatible or exclusive with respect to each other.

DETAILED DESCRIPTION OF THE INVENTION

Moreover, various other features of the invention emerge from the appended description made with reference to the drawings that illustrate non-limiting embodiments of the invention, and wherein.

It is to be noted that, in these figures, the structural and/or functional elements common to the different alternatives may have the same references.

Figure 1:
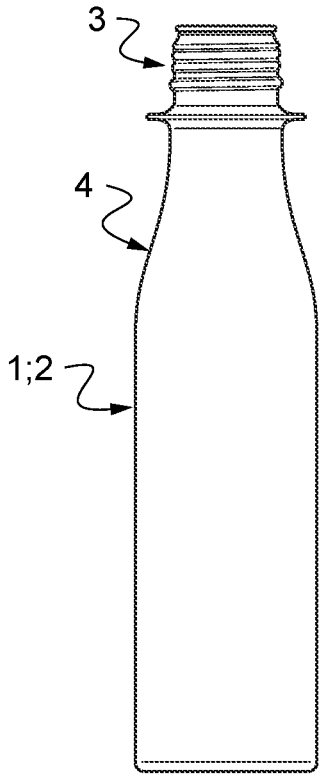
FIG. 1 is a general and schematic view of a bottle-shaped metal packaging, resulting from a manufacturing method according to the invention.
Figure 2:
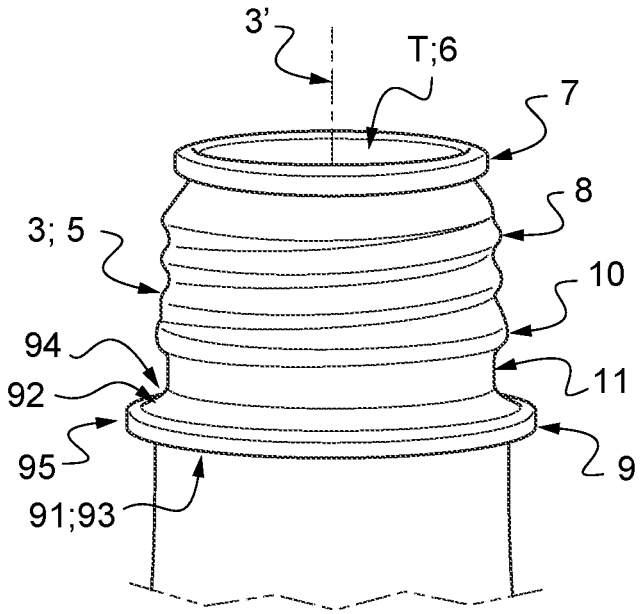
FIG. 2 is a partial and schematic view of the metal packaging according to FIG. 1, illustrating in more detail the threaded neck thereof.
Figure 3:
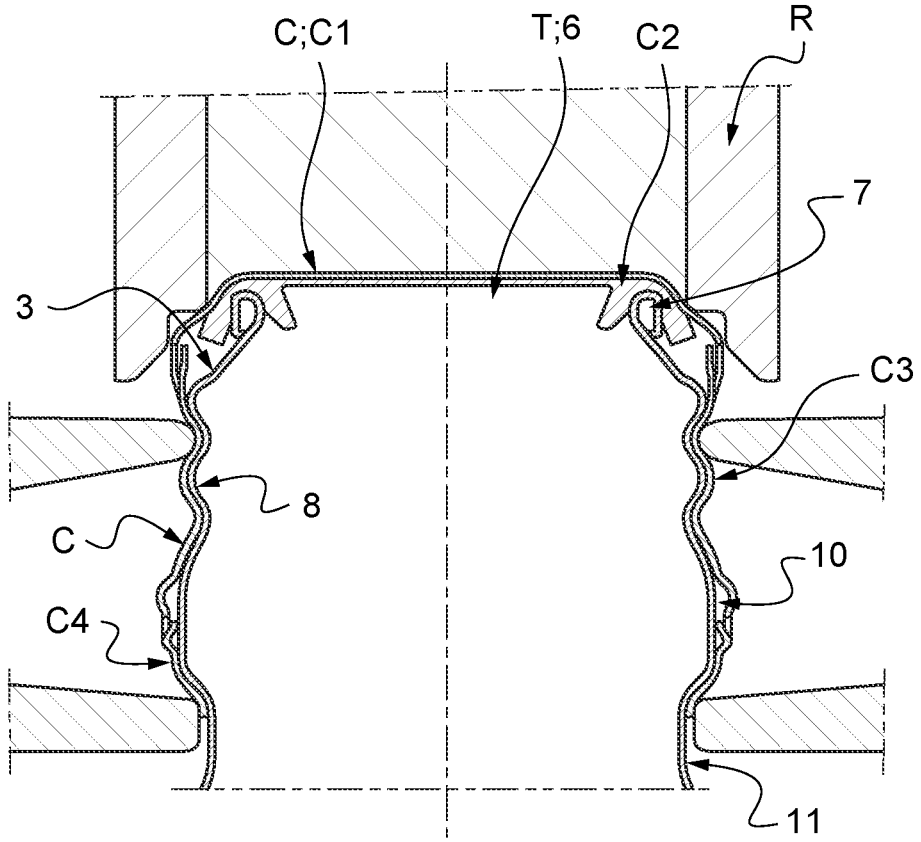
FIG. 3 is a schematic cross-sectional view of a step of putting a metal capsule on the threaded neck.

FIGS. 1 to 3 thus show a bottle-shaped metal packaging resulting from the method according to the invention.

Generally, such a metal packaging is advantageously made of aluminium or steel.

By way of example only, the metal packaging 1 is made of a 3000 or 5000 series aluminium alloy, for example 3104 aluminium alloy.

Such a metal packaging 1 advantageously consists of a container or receptacle, intended to receive for example a liquid product (especially beverages), a pasty or solid product (especially powders or granules).

This metal packaging 1 is for example a bottle, a vial or a can.

This metal packaging 1 is advantageously intended to be hermetically sealed, after filling, by means of a metal capsule C advantageously conventional per se (described hereinafter in relation with FIG. 3).

Generally, such a metal capsule C advantageously includes:

a bottom C1 provided with a compressible gasket C2, a skirt C3, intended to cooperate with a thread, and advantageously a pilfer-proof ring C4.

The bottle-shaped metal packaging 1 advantageously comprises a body 2 (or belly) that is connected to a threaded neck 3 (or mouth) through a shoulder 4.

The threaded neck 3 defines a longitudinal axis 3', here directed vertically and advantageously coaxially to the body 2.

This threaded neck 3 is consisted by a one-piece metal wall 5 that defines its circumference and that delimits an inner duct T ending at a downstream opening 6 opposed to the shoulder 4 (FIGS. 2 and 3).

The general horizontal cross-section of this threaded neck 3, perpendicular to the longitudinal axis 3', is here of circular shape; it could as well be oval, rectangular or square for example.

The threaded neck 3 of this metal packaging 1 includes a succession of one-piece structures, illustrated in particular in FIGS. 2 and 3, i.e.:

a roll 7, at the downstream opening 6 of the threaded neck 3, advantageously intended to cooperate with the bottom C1 of the capsule C (see in particular FIG. 3), a thread 8, advantageously intended to cooperate with the skirt C3 of the capsule C, a transport ring 9, on the shoulder 4 side, intended to cooperate with a handling device (non shown), and possibly, a pilfer-proof counter-ring 10, forming a pilfer-proof counter-ring groove 11 with the transport ring 9, advantageously intended to cooperate with the pilfer-proof ring C4 of the capsule C.

The downstream opening 6 of the tubular part 1 is here consisted by the roll 7 that is directed outward, delimiting this downstream opening 6 from the internal duct T (FIGS. 1 and 2).

The thread 8 forms means for receiving a plug or a capsule (FIG. 3), herein in the form of a helical thread.

The transport ring 9 advantageously comprising at least one moulding 9 that is formed in a plane extending perpendicular to the longitudinal axis 3' and along the circumference of the threaded neck 3.

Said at least one moulding 9 has a lower surface 91 and/or an upper surface 92 against which a handling device (not shown) is intended to bear.

This handling device (not shown) advantageously has a fork shape, of the type conventionally met in the field of handling of plastic bottles provided with a transport ring.

By "moulding", it is meant in particular a rib in the one-piece metal wall 5 (commonly called "a bead"), either recessed or raised, obtained for example by heading or by spinning.

The moulding 9 is here continuous, extending over the whole circumference of the threaded neck 3.

The moulding 9 is here arranged projecting outwards from the threaded neck 3.

The vertical cross-section of this moulding 9 is advantageously identical or at least approximately identical over its circumference, without geometric break.

Generally, the lower 91 and upper 92 surfaces of said at least one moulding 9 advantageously have a crown shape.

Said at least one moulding 9 is also defined by different radii:

a lower connection radius 93, on the shoulder 4 side, an upper connection radius 94, on the thread 8 side, an outer radius 95, connecting the two lower 91 and upper 92 surfaces.

Advantageous characteristics relating to the shape of this moulding 9, as well as the forming and calibration thereof, will be described in more detail hereinafter in relation with FIG. 6 and following.

Generally, the present invention relates to the method for manufacturing such a bottle-shaped metal packaging 1.

Figure 4:
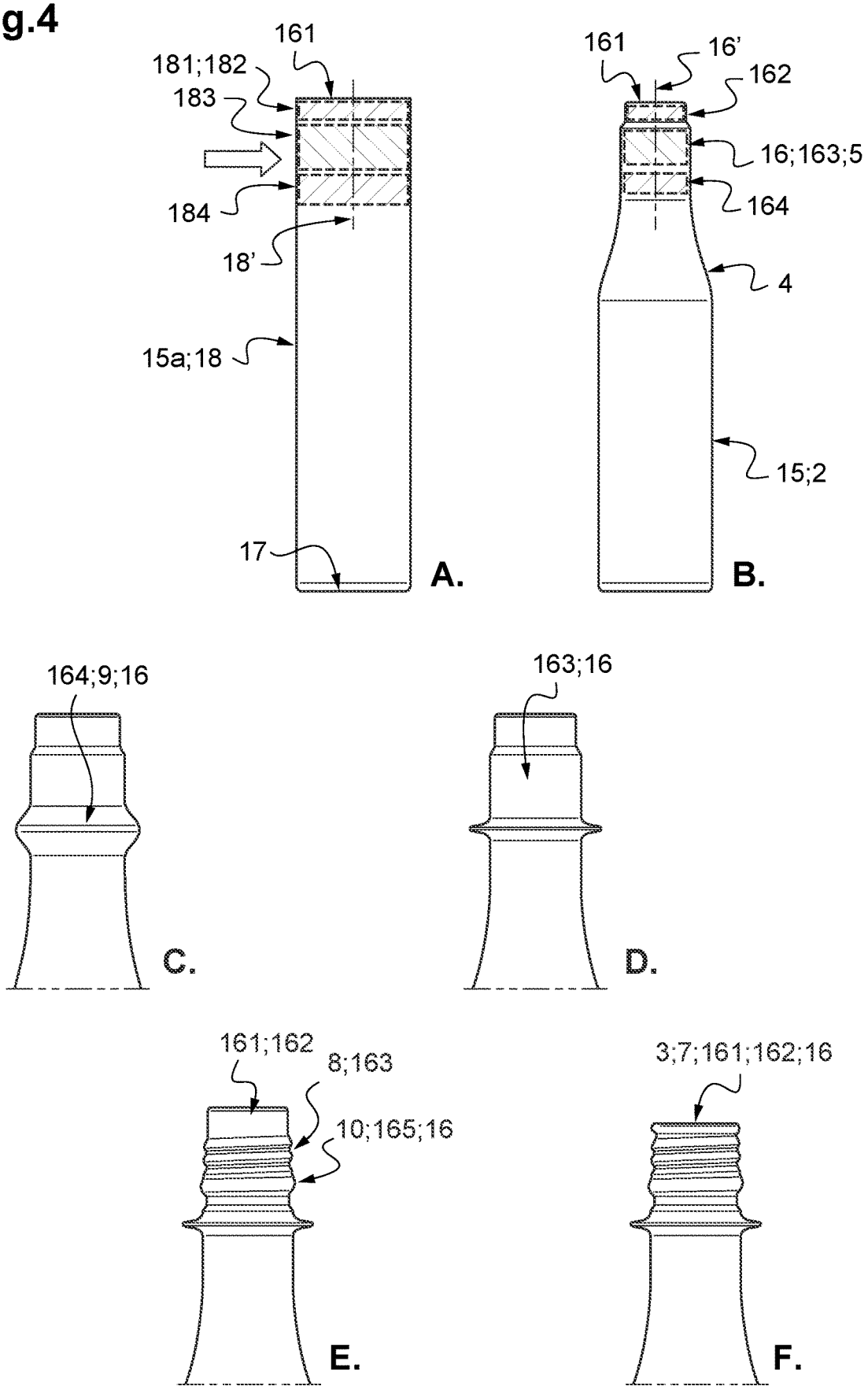
FIG. 4 is a schematic view illustrating the main phases/steps of the manufacturing method according to the invention for manufacturing the bottle-shape metal packaging.

As illustrated in FIG. 4, the manufacturing method according to the invention comprises successive steps:

a step of manufacturing a preform 15 having a tubular part 16 (intended to be subsequently formed in such a way as to constitute the threaded neck 3), which is connected to the body 2 through a shoulder 4 (items A and B in FIG. 4), then a step of forming this tubular part 16, to form the threaded neck 3 (items C to F in FIG. 4).

In particular, the tubular part 16, intended to form the threaded neck 3 after forming, defines a longitudinal axis 16' and a free, downstream edge 161.

For the manufacturing of the threaded neck 3 in this tubular part 16, the forming step comprises operations of forming the one-piece metal wall 5 which are adapted to form the different one-piece structures 7, 8, 9 and 10 of the threaded neck 3 within superposed strips of the tubular part 16.

Herein, as also illustrated in FIG. 4, the forming operations comprise:

an operation of forming a roll 7 within a downstream strip 162 of the tubular part 16, ended by the downstream edge 161, to form the roll 7 at this downstream edge 161 of the threaded neck 3 (items E and F in FIG. 4), an operation of forming the thread 8 within an intermediate strip 163 of the tubular part 16 (items D and E in FIG. 4), and an operation of forming the transport ring 9 within an upstream strip 164 of the tubular part 16, on the shoulder 4 side, by a metal fold forming an annular deformation (items B to D in FIG. 4), and possibly an operation of forming the pilfer-proof counter-ring 10 within an additional strip 165 of the tubular part 16, located between the intermediate strip 163 and the upstream strip 164.

According to a particular embodiment, the step of forming the tubular part 16 comprises an operation of necking the downstream strip 162 of the tubular part 16, prior to the roll 7 forming operation (see item B of FIG. 4).

The roll 7 forming operation is then advantageously adjusted to form the roll 7 outwards and in such a manner that the outer diameter of this roll 7 is lower than or equal to the thread 8 bottom diameter (see in particular FIG. 3).

According to the embodiment illustrated in FIG. 4, the transport ring 9 forming operation (items C and D) is carried out before the roll 7 forming operation (item F).

This operation arrangement makes it possible to use the transport ring 9 for holding the tubular part 16 during the roll 7 forming operation, or even also during the posterior thread 8 forming operation.

Without limitation, and independently of each other, the forming operations are applied over the following respective heights:

a downstream strip 162 of 3 to 7 mm, an intermediate strip 163 of 10 to 25 mm, and an upstream strip 164 of 5 to 15 mm.

Preferably, the manufacturing method may also comprise a step of putting a metal capsule C on the threaded neck 3 (FIG. 3).

This operation is implemented by a technique conventional per se.

The capsule C is made integral with this threaded neck 3 using a rotating capsuling head R.

For example, the rotating capsuling head R performs three simultaneous operations:

the central tip of the rotating capsuling head R, by applying an axial load to the capsule C, compresses the gasket C2 to the upper part of the roll 7 of the metal packaging 1 and redraws the upper angle of the capsule C to apply the gasket C2 on the outer face of the roll 7, wheels rotating about the skirt C3 of the capsule C apply an axial force that pushes the metal of the skirt C3 into the thread 8 recesses, thus creating the skirt C3 thread, and wheels rotating about the pilfer-proof ring C4, crimp it under the protrusion of the pilfer-proof counter-ring 10.

At the end of the manufacturing process, a bottle-shaped metal packaging 1 is obtained, as illustrated in FIGS. 1 to 3.

Localised Annealing Step

The manufacturing method according to the invention comprises, prior to at least the roll 7 forming operation, a localised annealing step that is carried out to provide annealed state to the tubular part 16, at least over the height of the downstream strip 162 of the tubular part 16 (very schematically illustrated by item B in FIG. 4).

In other words, the localised annealing step is advantageously carried out in such a way that the tubular part 16 has a localised state that is variable over its height.

In still other words, the tubular part 16 advantageously has over its height, an annealing gradient.

Still preferably, the localised annealing step is carried out to provide annealed state only to the tubular part 16, at least over the height of the downstream strip 162 of the tubular part 16.

In other words, only the tubular part 16 is in annealed state, at least over the height of the downstream strip 162 of the tubular part 16. The body 2 and/or the shoulder 4 are advantageously in non-annealed state.

Generally, the localised annealing step is advantageously carried out to provide annealed state:

only at the downstream strip 162 (intended to form the roll 7), only at the downstream strip 162 and the upstream strip 164 (intended to form the roll 7 and the transport ring 9, respectively), in such a way as to keep at least part of the height of the intermediate strip 163 in non-annealed state to provide the thread 8 with optimum mechanical strength qualities, or at the downstream strip 162, the intermediate strip 163 and the upstream strip 164, or even over the whole height of the tubular part 16 intended to form the threaded neck.

Such a localised annealing step has for interest to modify material property, elasticity limit, ductility and elongation at break, providing malleability to the constituent material of the tubular part 16.

The annealing step thus makes it possible to form the threaded neck 3, allowing a thickness reduction of the metal packaging 1 body while preserving resistance to capsuling forces.

For example, the one-piece metal wall 5 has a thickness from 0.2 to 0.5 mm.

Preferably, the annealing step is also applied prior the tubular part 16 forming step (that is to say before forming the different one-piece structures 7, 8, 9 and 10 of the threaded neck 3, within superposed strips 162, 163, 164, 165 of the tubular part 16).

Preferentially, the localised annealing step is carried out to provide annealed state over a height of at least 3 to 7 mm to the downstream strip 162 of the tubular part 16, from the downstream edge 161.

Likewise, localised annealing step is advantageously carried out to provide annealed state over the height of the upstream strip 164 of said tubular part 16, advantageously over a height of 5 to 15 mm.

As developed hereinafter, the localised annealing step is advantageously implemented on a primary preform 15*a* including a tubular wall 18, a downstream section 181 of which is intended to undergo a necking to form the tubular part 16 of the preform 15.

Implementing this localised annealing step on this downstream section 181, then necking this downstream section 181, has for interest to provide interesting mechanical properties for the tubular part 16 forming operations (advantageously, the mechanical necking work restores part of the strain hardening).

Generally, the localised annealing step may be implemented to provide annealed state to other parts of the preform 15, 15*a*, for example the body 2 or the shoulder 3 to facilitate the forming thereof.

Still generally, in this localised annealing step, the metal of the preform 15, 15*a* is advantageously subjected to a high temperature, generally in the range from 150 to 450° C., such as from 200 to 400° C. and still preferably from 200 to 350° C.

The annealing is made at a suitable temperature for a suitable time period to obtain the desired reduction of the elasticity limit or improvement of the ductility and elongation at break.

Generally, for aluminium, the temperature is between 200° C. and 400° C.

For high-temperature annealing, the annealing temperature is higher, for example 350° C. to 454° C. for a duration from 1 μs (microsecond) to 1 h (hour), for example 0.1 s (second) to min (minutes), 1 s to 5 min or 10 s to 1 min.

For steel, the annealing temperature range is normally far higher and may be for example from 500° C. to 950° C., and the time period may for example be from 1 μs to 1 h, such as 0.1 s to 30 min, 1 s to 5 min, or 10 s to 1 min.

The annealing process causes reduction in hardness, reduction in elasticity and increase in ductility.

Figure 5:
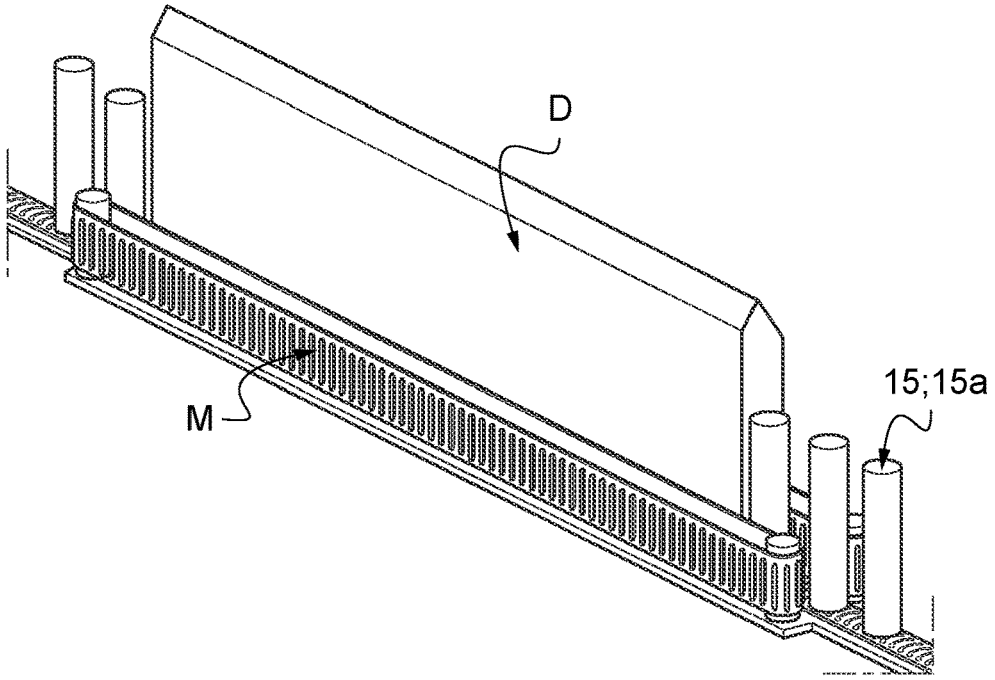
FIG. 5 is a schematic view of the localised annealing step that is applied to a preform during the manufacturing method according to the invention.

Generally, as illustrated in FIG. 5, the localised annealing step is implemented by an induction technique.

This induction technique is advantageously carried out within a tunnel inductor D, advantageously with rotation of the preforms 15, 15*a*.

This rotation is for example ensured by means M for rotating each preform 15, 15*a* about an axis of rotation parallel to its longitudinal axis (for example, the longitudinal axis 18' of the tubular wall 18 described hereinafter).

The rotation means M consist for example in a couple of conveyor lateral strips that include opposite strands sandwiching the preforms 15, 15*a* and travelling at a suitable relative speed to generate the rotation of the preforms 15, 15*a* during the localised annealing step.

The induction annealing is thus carried out by making the preforms 15, 15*a* travelling in the tunnel inductor D, with concentration of the magnetic field to obtain advantageously a partial annealing of the areas of interest of the tubular wall 18 by thermal conduction and/or convection.

This approach advantageously reduces the loss of axial strength of the thread 8, while improving the formability of the roll 7.

Preform Manufacturing Step

Prior to the forming of the tubular part 16 into the threaded neck 3, the preform manufacturing step advantageously comprises:

- a phase of deforming a metal part (not shown) to obtain a primary preform 15*a* comprising a bottom 17 extended by a tubular wall 18 advantageously having a constant diameter over its height (see item A in FIG. 4),
- an edge trimming phase, to form the downstream edge 161 of the primary preform 15*a* (item A in FIG. 4), and
- a necking step, here applied to a downstream section 181 of the tubular wall 18, to form the tubular part 16 of a secondary preform 15, the tubular part 16 of which is connected to the body 2 through a shoulder 4 (items A and B, in FIG. 4).

The deformation phase is advantageously selected among the techniques conventional per se, for example among drawing and/or wall ironing and/or inverted extrusion.

In particular, the drawing and/or the wall ironing is preferably applied to a metal part consisted of a metal blank having for example a thickness from 0.2 mm to 0.7 mm.

The drawing and/or wall ironing consist for example of a technique selected from drawing and wall ironing (DWI) or drawing and re-drawing (DRD).

The inverted extrusion is preferably applied to a slug of 2 to 15 mm.

Moreover, according to the invention and as mentioned hereinabove, the localised annealing step is advantageously applied prior to the tubular part 16 forming step.

Herein, this annealing step is applied prior to the necking step, preferably between the edge trimming step and the necking step.

This annealing step is thus advantageously applied to the tubular wall 18 of the primary preform 15*a* (item A of FIG. 4), prior to the necking step (item B of FIG. 4).

The localised annealing step is preferably applied to at least part of the height (or even over the whole height) of the downstream section 181 of the tubular wall 18 (intended to form the tubular part 16), as a function of the annealed/non-annealed state that is expected at the strips of the tubular part 16.

In particular, the localised annealing step is advantageously localised:

- only at a downstream portion 182 corresponding, after necking, to the downstream strip 162 (intended to form the roll 7),
- only at a downstream portion 182 and an upstream portion 184 corresponding, after necking, to respectively the downstream strip 162 and the upstream strip 164 (intended to form respectively the roll 7 and the transport ring 9), or
- at the downstream portion 182, an intermediate portion 183 and the upstream portion 184 corresponding, after necking, to respectively the downstream strip 162, the intermediate strip 163 and the upstream strip 164, or even over the whole height of the downstream section 181 intended to be necked to form the tubular part 16.

Generally, the method also advantageously comprises a phase of varnishing the preform 15, 15*a*, preferably an external varnishing phase and an internal varnishing phase.

This varnishing phase is preferably implemented after the localised annealing step, or even also prior to the necking step (between the items A and B in FIG. 4).

The varnishing phase, posterior to the localised annealing step, makes it possible to protect the varnish against thermal degradation.

Transport Ring Forming/Calibration Operation

La present invention also relates to the operation of forming, or even calibrating, the transport ring 9.

Figure 6:
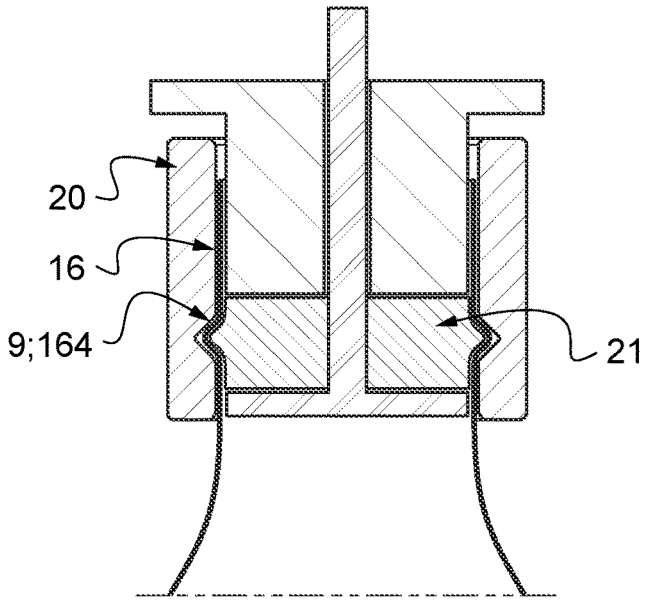
FIG. 6 is a schematic view of the transport ring forming operation implementing an elastomer-compression moulding technique.
Figure 7:
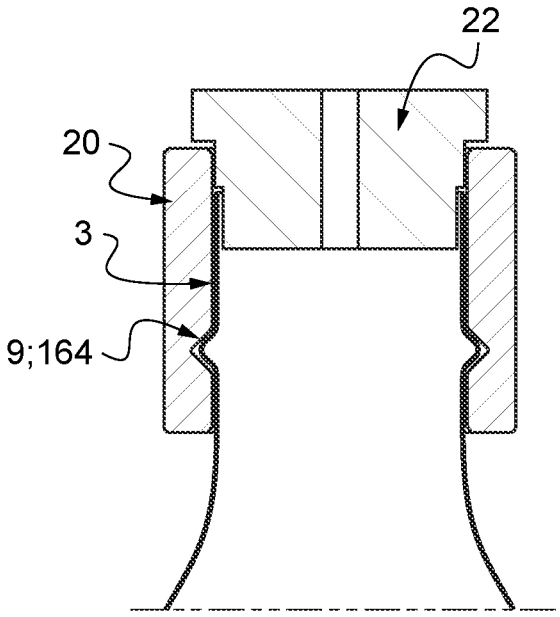
FIG. 7 is a schematic view of the transport ring forming operation implementing a moulding technique using an internal pressure exerted by a pressurized fluid.

The forming operation consists for example of a moulding technique (FIGS. 6 and 7).

In this sense, the moulding technique consists for example in applying an internal pressure that causes the one-piece metal wall 5 to conform to the shape of a mould 20.

This internal pressure is exerted for example by:

- the compression of an elastomer 21 (FIG. 6), or
- a pressurized fluid that is injected by means of an injection head 22 (FIG. 7).

Figure 8:
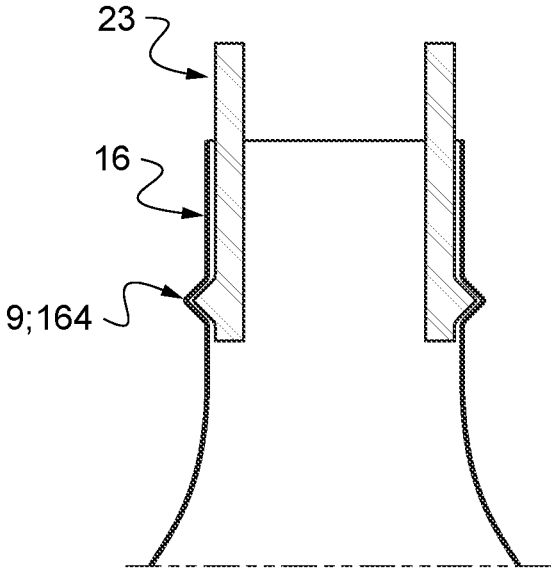
FIG. 8 is a schematic view of the transport ring forming operation implementing a direct mechanical action using expandable segments.
Figure 9:
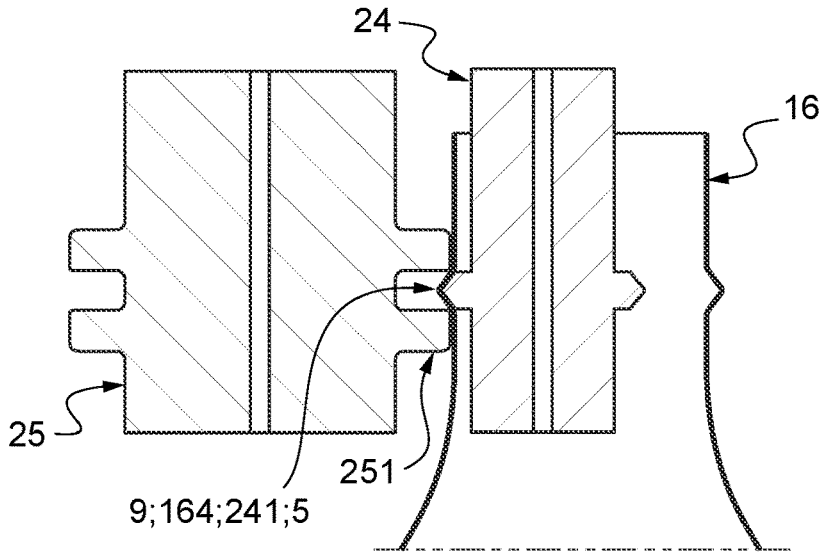
FIG. 9 is also a schematic view of the transport ring forming operation implementing a direct mechanical action by metal spinning by rotation of an internal wheel/external wheel couple.

The moulding technique may also consist in using expandable segments 23 (FIG. 8).

The forming operation may also consist in a direct mechanical action by the rotation of an internal wheel 24 on the internal face of the tubular part 16 while an external wheel 25, facing the first one, holds the metal of the one-piece metal wall 5.

Herein, the internal wheel 24 preferably comprises a single rib 241; and the external wheel 25 comprises a couple of ribs 251 located on either side of the single rib 241.

Figure 10:
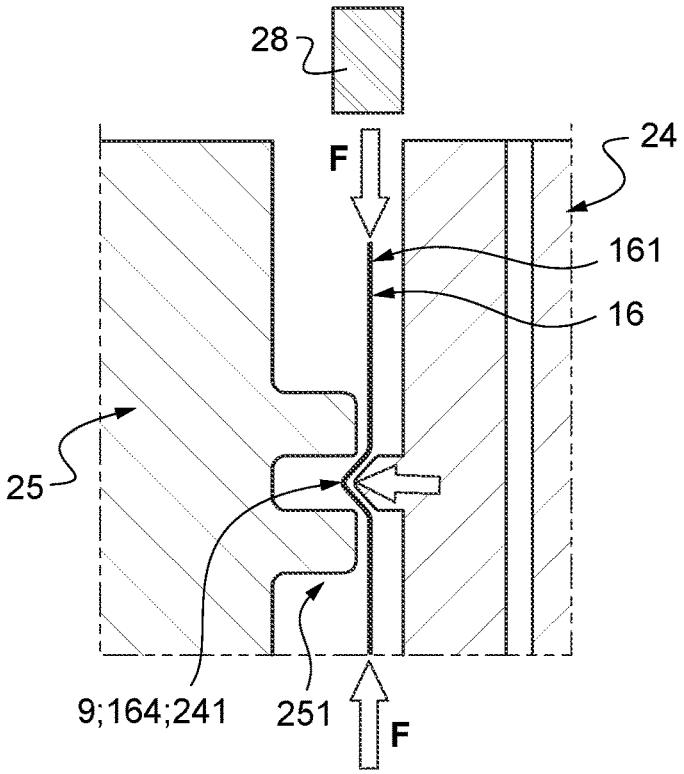
FIG. 10 is a schematic view that illustrates an axial load exerted on the metal packaging, during the transport ring forming operation.

Generally, during the transport ring 9 forming operation, an axial load F is advantageously exerted on the metal packaging 1, advantageously parallel to the longitudinal axis 16' of the tubular wall 16 (FIG. 10).

This approach has the advantage of accompanying the metal in its deformation and avoiding thinning and breakage.

This axial load is for example exerted by means of at least one pressing tool 28 that exerts an axial load on the tubular part 16 during the transport ring 9 forming operation.

Said at least one tool 28 may exert an axial load for example at the downstream edge 161 of the tubular part 16 and/or at the bottom of the body 2 (at the opposite of the tubular part 16, at the bottom 17).

Said at least one tool 28 may exert an axial load that is for example uniform over the whole circumference of the downstream edge 161 or localised in an area located on a generating line passing through the area of the transport ring 9 that is being formed.

This axial load is for example exerted by means of a pressing tool 28, for example crown-shaped, that exerts an axial load on the downstream edge 161 (towards the bottom 17 of the body 2).

Figure 11:
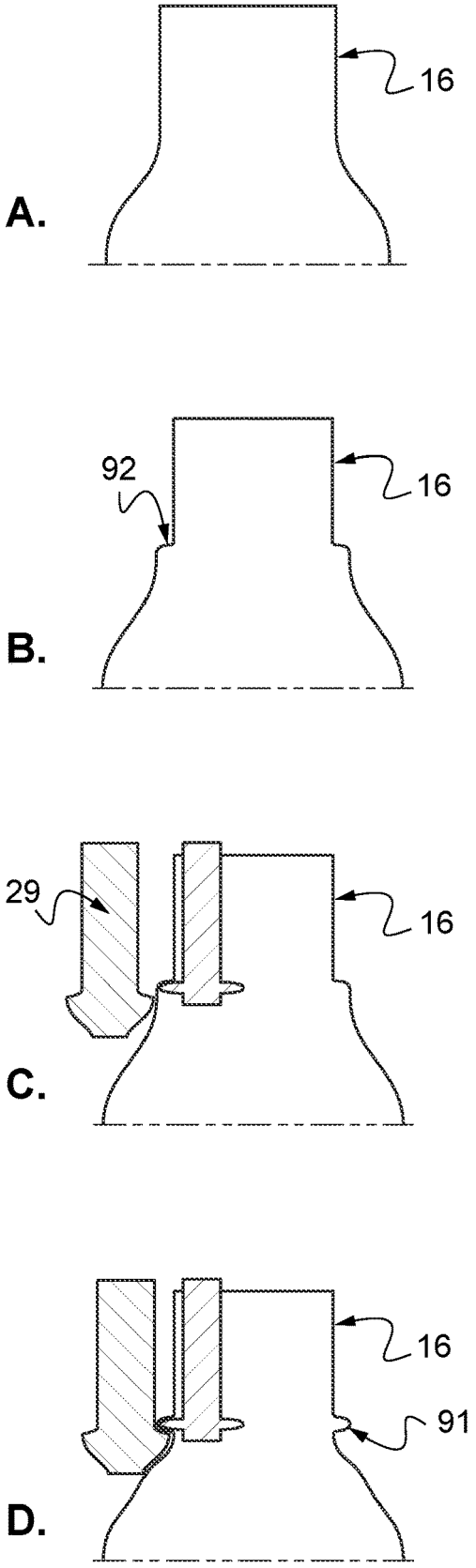
FIG. 11 is a schematic view that illustrates the transport ring forming operation implementing overlying and underlying neckings applied in the tubular part.

According to another embodiment illustrated in FIG. 11, the transport ring 9 forming operation may consist of a technique of overlying and underlying necking the tubular part 16.

For that purpose, for example, the successive phases are implemented:

- a phase of overlying necking the tubular part 16, to form the upper surface 92 of the transport ring 9 (items A and B in FIG. 11), then
- an underlying necking phase, to form the lower surface 91 of the transport ring 9, for example by means of a couple of wheels 29 (items C and D in FIG. 11).

Preferably, the transport ring 9 forming operation also comprises a calibration phase to give a definitive shape to the transport ring 9.

This calibration operation is in particular intended to deform the lower 91 and upper 92 surfaces of the transport ring 9 to give the latter its definitive shape.

Figure 12:
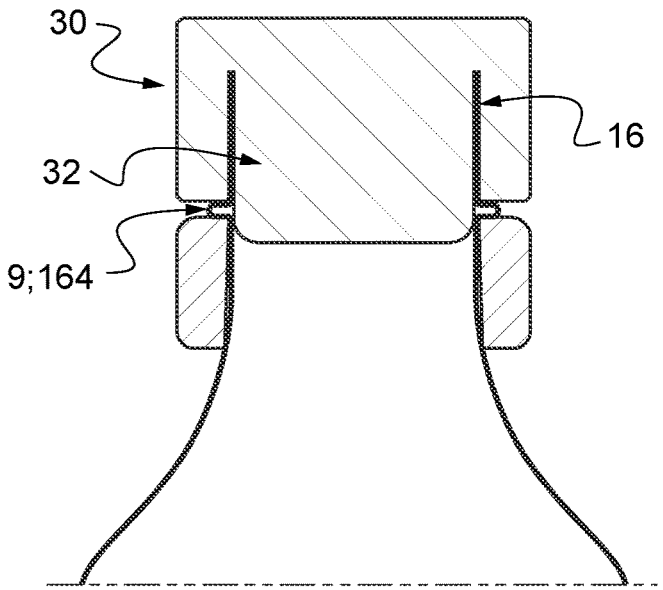
FIG. 12 is a schematic view of a transport ring calibration phase, to give a definitive shape to said transport ring, by implementation of two calibration rings.
Figure 13:
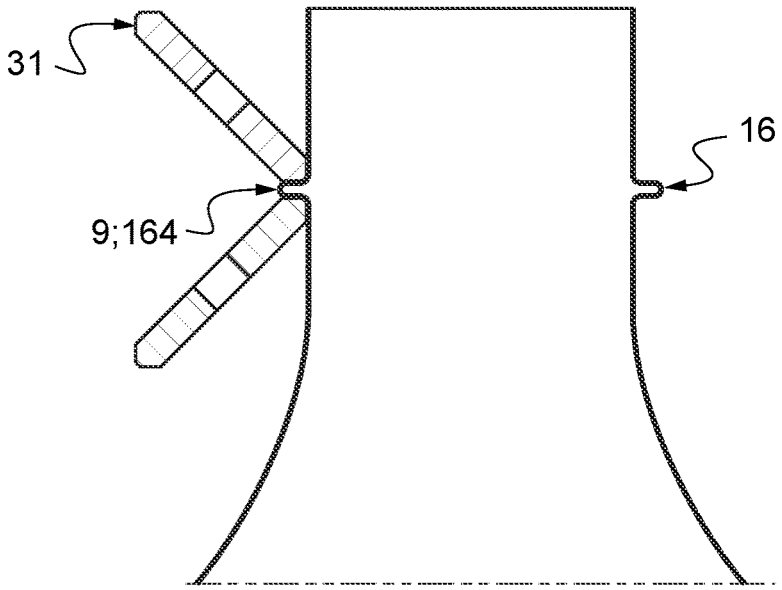
FIG. 13 is a schematic view of a transport ring calibration phase, to give a definitive shape to said transport ring, by implementation of two rotating wheels.

The calibration phase is for example made:

- by clamping the annular deformation between two calibration rings 30, which are coaxial to the longitudinal axis 16' of the tubular part 16 and that are operated in axial translation towards each other (FIG. 12), or
- by two wheels 31 rotating about the tubular part 16 (FIG. 13).

In particular, these calibration rings 30 and the wheels 31 are shaped/profiled/arranged in such a way as to define, after deformation, the shape of the lower 91 and upper 92 surfaces of the transport ring 9.

Preferably, a centring mandrel 32 (illustrated in FIG. 12) is introduced into the tubular part 16 during the calibration to ensure concentricity of the overlying and underlying parts of the tubular parts 16 (on either side of the transport ring 9).

Figure 14:
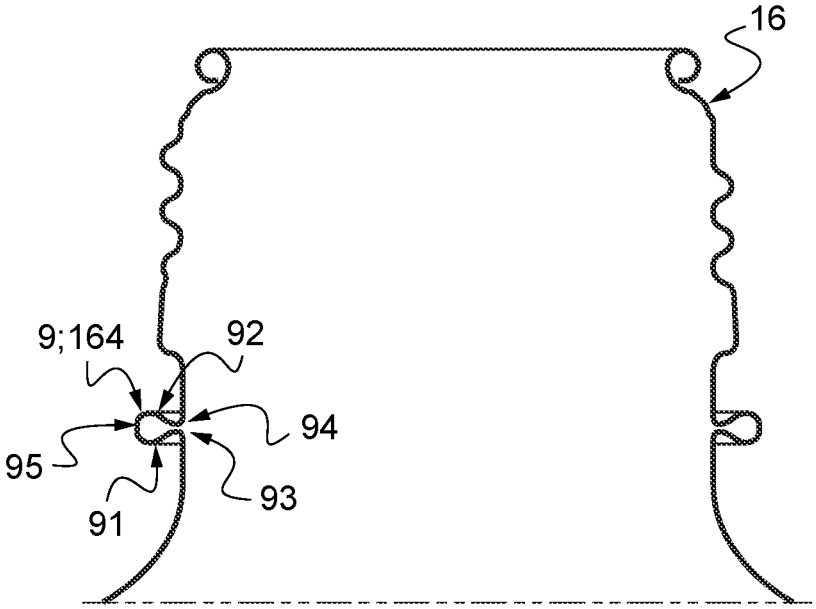
FIG. 14 is a schematic, partial and cross-sectional view of a threaded neck after the calibration phase, whose transport ring upper connection radius and lower connection radius are in contact with each other.

In practice, as illustrated in FIG. 14, the calibration phase consists for example in:

- bringing the upper connection radius 94 and the lower connection radius 93 of the transport ring 9 in contact with each other, in order to ensure the optimum transfer of the axial force towards the transport ring 9 during a capsuling operation (FIG. 14), and/or
- bringing the external radius 95 of the transport ring 9 to a minimum radius acceptable to the constituent material.

Figure 15:
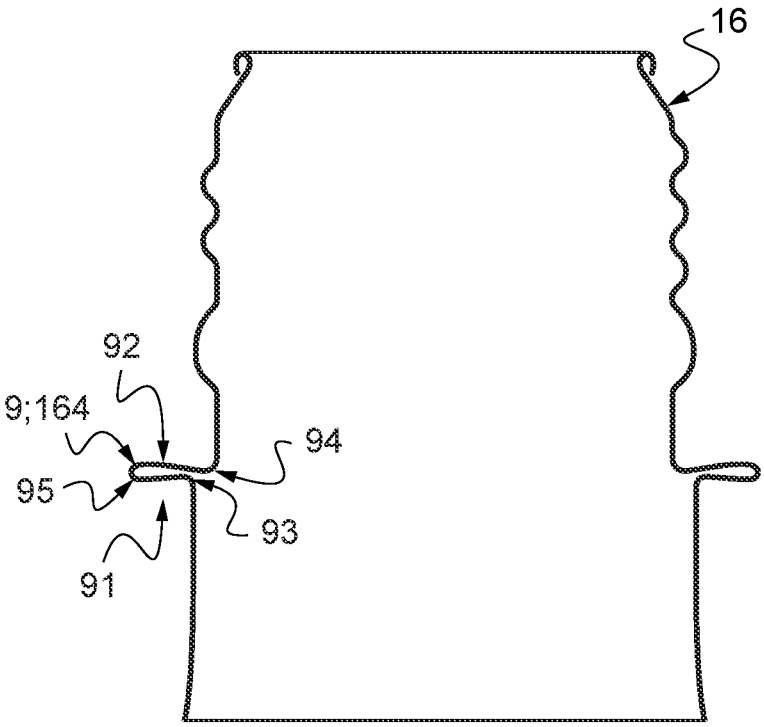
FIG. 15 is another schematic, partial and cross-sectional view of a threaded neck after the calibration phase, whose transport ring upper connection radius and lower connection radius are offset with respect to each other.

As an alternative, as illustrated in FIG. 15, the upper connection radius 94 and the lower connection radius 93 of the transport ring 9 are radially offset with respect to each other (while advantageously extending coaxially).

In this case, the diameter of the upper connection radius 94 (in a plane perpendicular to the longitudinal axis 16') is advantageously lower than the diameter of the lower connection radius 93 (in a plan perpendicular to the longitudinal axis 16') of the transport ring 9.

The lower connection radius 93 is advantageously in abutment against the upper surface 92 of the transport ring 9.

Such an embodiment offers a transport ring 9 whose upper surface 92 and lower surface 91 have different widths (the upper surface 92 is here wider than the lower surface 91).

This embodiment is obtained for example by a suitable set of wheels 29, similar to FIG. 11, for a technique of overlying or underlying necking of the tubular part 16 that has a diameter differential (the overlying and underlying diameters of the tubular part 16 are different relating to each other; the underlying diameter is here lower than the overlying diameter).

Of course, various other modifications may be made to the invention within the scope of the appended claims.

The invention claimed is:

1. A method for manufacturing a bottle-shaped metal packaging, said metal packaging having a body connected to a threaded neck through a shoulder, said method comprising:

- a step of manufacturing a preform including a tubular part, defining a longitudinal axis and a free, downstream edge, wherein said tubular part is connected to a body through a shoulder, and
- a step of forming said tubular part, to form said threaded neck,
- said forming step comprising forming operations suitable to form one-piece structures on said tubular part:
  - an operation of forming a roll within a downstream strip of said tubular part, ended by said downstream edge, to form the roll at the downstream edge of the threaded neck,
  - an operation of forming a thread within an intermediate strip of said tubular part, and
  - an operation of forming a transport ring within an upstream strip of said tubular part, on the shoulder side, configured to cooperate with a handling device,
- wherein said manufacturing method comprises, prior to at least said roll forming operation, a localised annealing step that is carried out in order to provide an annealed state to the tubular part, at least over a height of the downstream strip of said tubular part,
- wherein the localised annealing step is executed to provide the annealed state:
  - only at said downstream strip, or
  - only at the downstream strip and the upstream strip, in such a way as to keep at least part of a height of the intermediate strip in non-annealed state.

2. The method for manufacturing a bottle-shaped metal packaging according to claim 1, wherein the localised annealing step is carried out in order to provide the annealed state over a height of at least 3 to 7 mm of the downstream strip of said tubular part.

3. The method for manufacturing a bottle-shaped metal packaging according to claim 1, wherein the localised annealing step is carried out in order to provide the annealed state over a height of the upstream strip of said tubular part.

4. The method for manufacturing a bottle-shaped metal packaging according to claim 1, wherein the preform manufacturing step comprises:

- a phase of deforming a metal part to obtain a primary preform having a bottom extended by a tubular wall, an edge trimming phase, to form the downstream edge of said primary preform, and a necking step, to form said tubular part of a secondary preform, and wherein said localised annealing step is carried out on the tubular wall of the primary preform, before the necking step.

5. The method for manufacturing a bottle-shaped metal packaging according to claim 1, wherein the localised annealing step is carried out by an induction technique.

6. The method for manufacturing a bottle-shaped metal packaging according to claim 1, wherein the transport ring forming operation is implemented prior to the roll forming operation.

7. The method for manufacturing a bottle-shaped metal packaging according to claim 1, wherein the tubular part forming step also comprises an operation of forming a pilfer-proof counter-ring within an additional strip of the tubular part, located between the intermediate strip and the upstream strip, forming a pilfer-proof counter-ring groove between said pilfer-proof counter-ring and said transport ring.

8. The method for manufacturing a bottle-shaped metal packaging according to claim 1, wherein said method also comprises a varnishing phase.

9. The method for manufacturing a bottle-shaped metal packaging according to claim 1, wherein said metal packaging is made in a 3000 or 5000 series aluminium alloy.

10. The method for manufacturing a bottle-shaped metal packaging according to claim 1, wherein the transport ring forming operation is selected among:

a moulding technique, or a direct mechanical action using a movable tool, or an overlying and underlying necking technique.

11. The method for manufacturing a bottle-shaped metal packaging according to claim 1, wherein the transport ring forming operation comprises a calibration phase to give a definitive shape to said transport ring.

12. The method for manufacturing a bottle-shaped metal packaging according to claim 11, wherein the calibration phase consists in:

bringing an upper connection radius and a lower connection radius of the transport ring in contact with each other, or in obtaining an upper connection radius and a lower connection radius of the transport ring that are radially offset with respect to each other, with said lower connection radius, and/or bringing the external radius of the transport ring to a minimum radius acceptable to the constituent material.

13. The method for manufacturing a bottle-shaped metal packaging according to claim 12, wherein the calibration phase is made:

by clamping an annular deformation between two calibration rings, which are coaxial to the longitudinal axis of the tubular part, or by two wheels rotating about the tubular part.

14. The method for manufacturing a bottle-shaped metal packaging according to claim 1, wherein, during the transport ring forming operation, an axial load is exerted on the metal packaging to accompany the metal in its deformation and avoid thinning and breakage.

15. The method for manufacturing a bottle-shaped metal packaging according to claim 1, further comprising a step of putting a metal capsule on the threaded neck.

* * * * *